United States Patent [19]

McFadden

[11] Patent Number: 4,930,489

[45] Date of Patent: Jun. 5, 1990

[54] GAS OVEN HAVING FLAME SWITCHING

[75] Inventor: David H. McFadden, Lexington, Mass.

[73] Assignee: Gas Research Institute, Chicago, Ill.

[21] Appl. No.: 306,834

[22] Filed: Feb. 6, 1989

Related U.S. Application Data

[63] Continuation-in-part of Ser. No. 135,932, Dec. 21, 1987, Pat. No. 4,802,459.

[51] Int. Cl.[5] ..... A47J 37/00

[52] U.S. Cl. ..... 126/41 R; 126/41 D; 126/39 R; 126/39 E; 99/467

[58] Field of Search ..... 126/41 R, 41 D, 273 R, 126/273 A, 1 R, 1 E, 37 R, 15 R, 15 A, 19 R, 19 M, 21 R, 21 A, 39 R, 39 C, 39 D, 39 E; 99/467

[56] References Cited

U.S. PATENT DOCUMENTS

| | | | |
|---|---|---|---|
| 2,413,447 | 12/1946 | Greene | 126/41 |
| 3,090,371 | 5/1963 | Davis | 126/39 C X |
| 3,624,742 | 11/1971 | Hurko et al. | 126/41 R |
| 4,336,789 | 6/1982 | Ogawa | 126/21 A |
| 4,506,598 | 3/1985 | Meister | 126/21 A |
| 4,598,691 | 7/1986 | Herrelko et al. | 126/41 R |
| 4,648,377 | 3/1987 | Van Cany | 126/21 A |

*Primary Examiner*—Larry Jones

*Attorney, Agent, or Firm*—George W. Dishong

[57] ABSTRACT

This invention is directed to a flame switchable gas burning device, adapted to be mounted or attached within the oven cavity of a gas stove, which provides an improved gas stove having control of the flame switching air and the convection cooking air. Such control is achieved by providing a shunt air path which may have one or more controlled dampers and a blower with variable and controllable speed. In another embodiment the combustion gases and the cooking air are kept separate by incorporation of a counterflow heat exchanger making the device indirect fired. In the indirect fired embodiment steam may be controllably introduced into the oven cavity to further speed the baking/cooking time. The improved gas oven can, within the one oven cavity, operate in the broil, bake, steam cook, and self-clean mode without the need for multiple burners or multiple oven cavities and without the need for manually operated baffles or dampers.

37 Claims, 11 Drawing Sheets

GAS OVEN HAVING FLAME SWITCHING

RELATED APPLICATION

This application is a continuation-in-part of application Ser. No. 135,932 filed on Dec. 21, 1987 now U.S. Pat. No. 4,802,459

FIELD OF THE INVENTION

This invention most generally relates to an improved gas stove which has a flame switchable burner assembly wherein the improvements speed the cooking time through the control of the convection/cooking air and/or by the introduction of steam into the oven cavity.

This invention more generally relates to direct or indirect fired single burner gas stoves, having a bake oven with a shunt path for the recirculated convection air for the direct fired burner embodiment and an optional steam cooking capability when the burner is indirect fired. By indirect fired burner it is meant that the combustion gases are kept separate, in part through the use of a heat exchanger and appropriate ducts, from the convection air used in the baking mode. Because of such separation, it is feasible to inject steam into the oven to decrease baking time. The gas stoves may be used either commercially and/or in the home and may be self-cleaning and a broil capability. More particularly the invention relates to a new single burner flame switchable gas burning device or assembly in which the functions of bake, broil, and self-clean are accomplished with a single burner tube in which the flame is switched in order to operate in the broil or in the bake/self-clean mode. In the broil mode the radiant heat to the broiled products is indirect radiant heat in that the flame does not "see" the broiling products. For the direct fired embodiment of the flame switching device there is also provided a "shunt path" for the purpose of shunting a portion of the recirculation air from the oven cavity without such shunt air operating to effect the flame switching at the burner. The volume of air in the shunt path may be controlled via a controlled damper preferably placed in the shunt air vent located on an oven cavity wall. Further, the recirculation air blower may be variable in speed to control the baking regimen when such a shunt path having a controlled damper is incorporated into the oven. There is thus provided additional convection flow without the increase in the air flow across the burner tube. The shunt path or the shunt air recirculation loop, which does not have in the path the burner and the flame switching region, allows the use of more recirculated convection air without affecting the amount of switching air needed for the effective flame switching at the burner tube.

DESCRIPTION OF THE PRIOR ART

Common gas oven configurations can be divided into two approaches: The single cavity for bake and broil, and an oven which features a large bake cavity and a smaller drawer for broiling. The single cavity designs use two separate burners to achieve bake and broil conditions whereas the two compartment approach shares a common burner.

To achieve bake conditions the single oven utilizes a gas burner subassembly located under the floor of the oven. The hot products of combustion flow through openings in the oven floor and heat the oven surfaces and interior space. This method of heating prevents the baked goods from looking directly at the burner. Broiling is accomplished by exposing the top surface of the food product directly to a highly radiant burner subassembly.

In a single oven approach, a separate broil burner is mounted at the top of the oven cavity looking directly down on the oven space. Typical broil burners are radiant screen or blue flame burner where the flame rolls over a metal spreader. With either approach, the burner looks directly at the food imparting a high radiant heat flux to the product. A single oven cavity approach is the typical configuration used for obtaining pyrolytic cleaning or self-cleaning oven performance. This cleaning process occurs when the soiled surfaces of the oven cavity reach temperatures in excess of 800° F. which usually corresponds to oven air temperatures in the range of 875° F. to 925° F. Maintaining this high temperature condition for an extended period of time will result in the reduction of food soils to a powdery ash residue. This cleaning process is most effective except in the regions of the door gasket where the short conduction paths to the cooler door result in somewhat cooler surfaces with resulting reduction in cleaning performance.

This single cavity gas range is a relatively recent advancement in oven design. In the older design, the oven is configured with a large baking oven cavity and a lower smaller broiler cavity. A single burner is mounted between the two cavities and this burner looks directly into the broiler drawer for the desired radiant input to the food. During bake the hot gases produced by the single burner flow through the oven floor into the bake cavity. This oven design is not typically or readily adapted or adaptable for self-cleaning temperatures.

U.S. Pat. No. 3,973,551 to Caselini et al discloses an arrangement which is substantially different from the subject invention in that it uses a single bottom burner combined with a recirculating fan or blower for circulating hot air throughout the oven. While the specification indicated that the oven can direct substantial heat from the top area, it is not specifically seen to disclose a capacity for broiling in the conventional sense.

German AS 1 241 080 is of interest as regards the disclosed invention in that it illustrates the use of a single top burner and a recirculating fan for heating an enclosed oven cavity. However, hot gases are not circulated through the oven, but rather around the oven cavity. Thus, there is not observed a broiling capacity and the overall arrangement is substantially different from the subject invention.

U.S. Pat. No. 3,659,579 to Henderson et al shows an oven capable of baking and broiling, as well as self-cleaning. A single burner at the top of the oven is utilized as both a broiling and baking burner, with a recirculating fan arranged to move hot air and products of combustion throughout the oven space. It is to be noted that both broiling and baking heat are supplied from the top of the oven, with the burner having a two-position configuration for broiling or baking. The overall arrangement of the burner and recirculating fan are seen to be considerably different from that used in the subject invention as disclosed herein by Applicant.

U.S. Pat. No. 3,437,085 to Perry shows a single top burner arrangement for an oven that can bake, broil or self-clean. However, there is not seen to be disclosed in this patent any arrangement comparable to the recirculating/diverting fan arrangement used in the subject invention.

In addition to the comments above, it should be further noted that while both Henderson and Perry offer broiling and baking, they differ significantly from Applicant's invention in that both use forced air (pressurized) burners and Henderson must use a manually operated damper to move between broil and bake as compared to flame switching and Perry uses two gas lines, three burner to move between broil and bake modes.

It would be advantageous to provide a gas fired oven having one burner which would operate in the broil, bake and self-clean mode and which would use one burner device and one oven cavity which would be used for both broiling and baking. It would also be advantageous if the oven did not require the use of complicated controls and devices in order to effect acceptable broiling and baking and where the emission standards and performance standards are met and/or exceeded using simple devices and simple controls. It would be of additional advantage if the amount of oven air used for baking could be increased and/or controlled without effecting the flame switching air and it would be of further advantage if the combustion air and the oven air could be kept separate allowing for the introduction of steam into the oven cavity.

SUMMARY OF THE INVENTION

The present invention in it's most simple form or embodiment is directed to a single tube flame switchable burner device for [as a broiler] broiling, baking and self cleaning in a gas stove having an oven cavity wherein the gas stove has incorporated therein means for controlling the oven/convection/recirculation air. The gas burner device is comprised of a burner tube having a plurality of flame holes so situated on the burner tube so that a flame will develop in a direction toward the oven front. Because of the combination of a flame spreader plate and a shield plate (which shield plate is attached in a sealed manner to the top of the oven cavity for the indirect fired embodiment of the invention) positioned relative to each other and relative to the burner tube so as to define a broil flame channel and because of fresh air which is directed onto the burner tube through an upper and a lower gap the flame will develop onto or attach to the upper surface of the shield plate and be below the downward facing surface of the spreader or within the broil flame channel defined by such two surfaces. The shield plate is heated and radiates heat to the product which is to be broiled. The broil flame channel height diminishes going from the burner tube toward the front or forward facing channel opening. The channel further slopes upward from the burner tube toward the front-facing broil channel opening to substantially compensate for the natural buoyancy of the broil flame.

By including a means for creating a low pressure zone above and rearward of the burner tube of the above described broiler device, the device becomes a flame switchable gas burning device. The flame which is established as a broil flame and which is established within the broil flame channel will, when a low pressure zone is created above the burner tube, shorten and bend and develop into the low pressure zone which physically may be a draw vent. The flame is shortened and is used to heat the air which is circulated through the low pressure zone and back into the oven cavity. Such heat is convection heat and is useful for baking products within the oven cavity. Without the low pressure zone, which typically may be created by a hot air pump or blower, the flame is a broil flame which provides heat for radiant heating. Turning on the hot air pump and thereby creating the low pressure zones causes the flame to switch and become a source of convection heat for baking and for oven self-cleaning.

A primary object of the present invention is to provide an improved gas stove which has better broiling, baking and self-cleaning characteristics than currently available gas stoves and which meet or exceed the established ANSI Z-21.1 emission standards and has a temperature profile which meets or exceeds all ANSI gas oven design requirements.

It is a further primary object of the invention to provide a flame switchable gas burning device which is attachable within an oven cavity of a gas stove which device makes the oven a broil or a bake/self-clean oven simply by causing, by the creation of a low pressure zone, the flame emanating from the flame ports of the burner tube to switch from being established in the broil flame channel when there is no low pressure zone, to being established in the direction of the low pressure zone within, typically, a draw vent located to the rear of and above the flame ports and further providing a means for variably controlling the amount of recirculation air which is used as the convection air in the oven cavity.

A still further primary object of the invention is to provide a means for indirect firing of a flame switchable gas burner device switchable from being a radiant heat source to a convection heat source. In this instance indirect firing shall mean the keeping of the combustion gases separate from the oven convection air. The indirect firing is achieved in part through the use of a heat exchanger and appropriate ducts, thus permitting and making feasible the introduction of steam into the oven cavity.

These and further objects of the present invention will become apparant to those skilled in the art after a study of the present disclosure of the invention.

DESCRIPTION OF THE PREFERRED EMBODIMENTS

The following is a description of the preferred embodiments of the invention. For the purpose of illustration, the method and device of the instant invention will be described primarily with regard to how the device and method is used within a gas stove and particularly within an oven cavity of a typical consumer type of gas stove appliance. It is understood that the flame switchable gas burning device as illustrated and described herein may have different dimensions and variations of the illustrated basic geometry.

Figure 1:
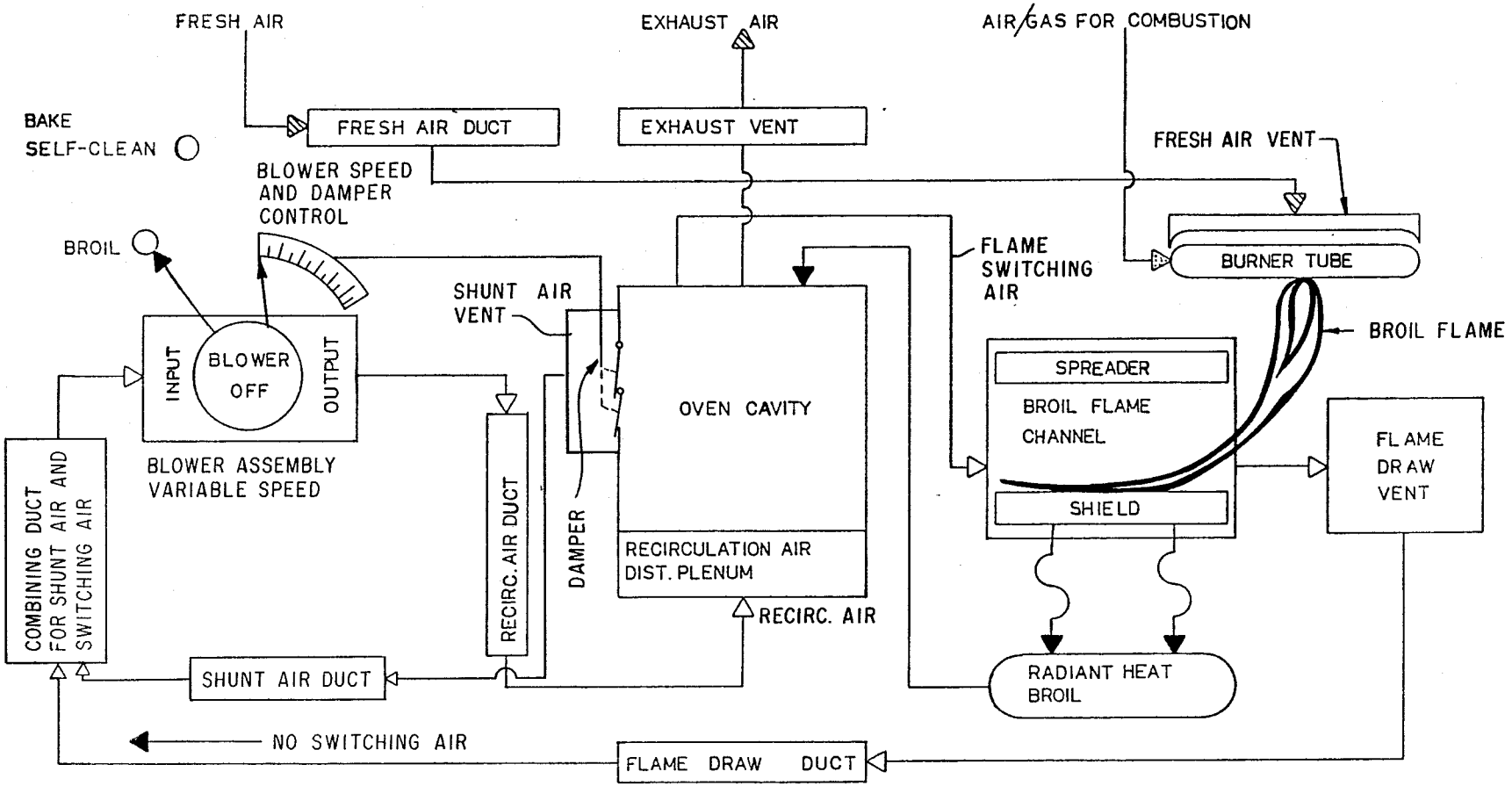
FIG. 1 is a schematic representation of the invention operating in the broil mode.
Figure 2:
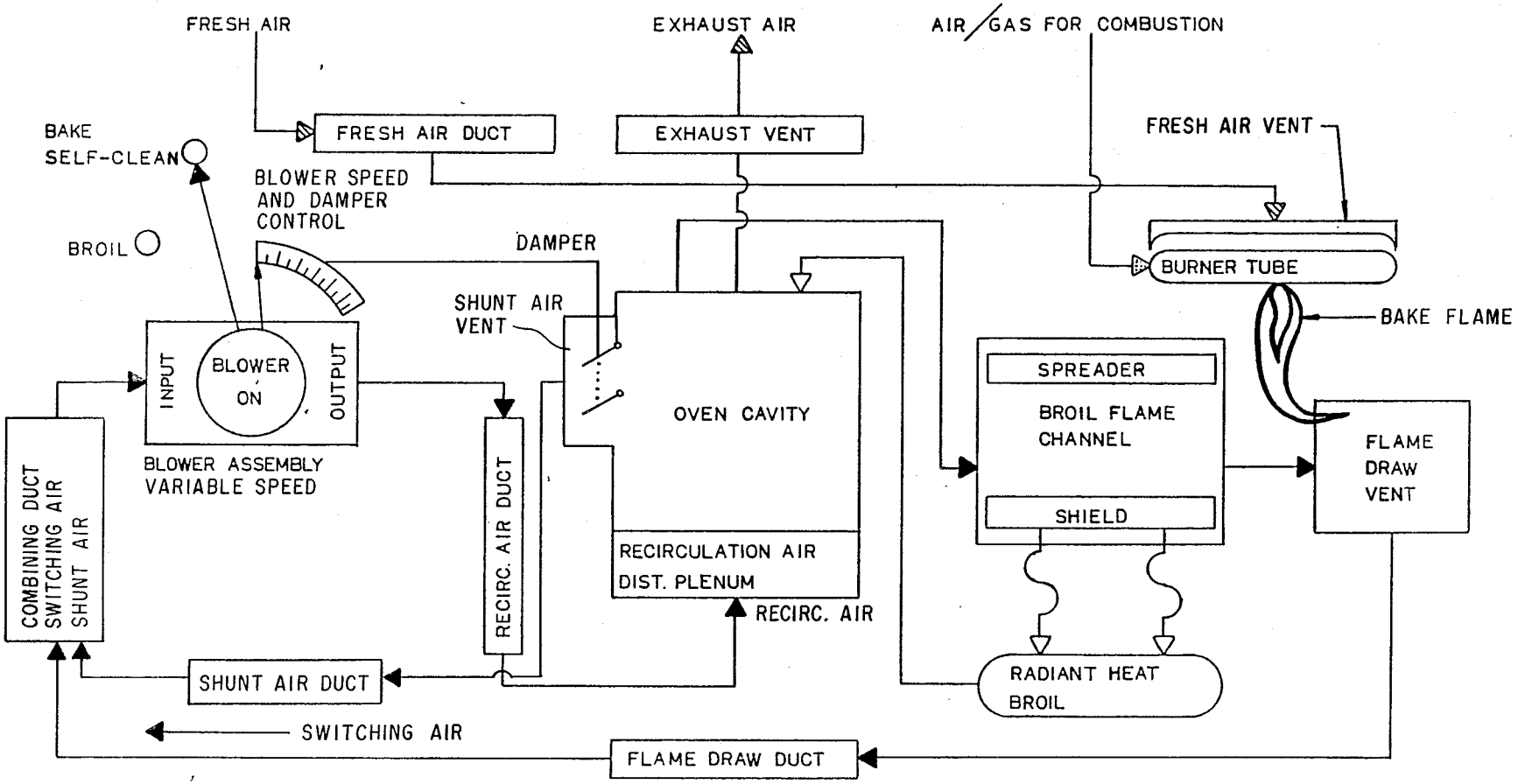
FIG. 2 is a schematic representation of the invention operating in the bake mode.
Figure 3:
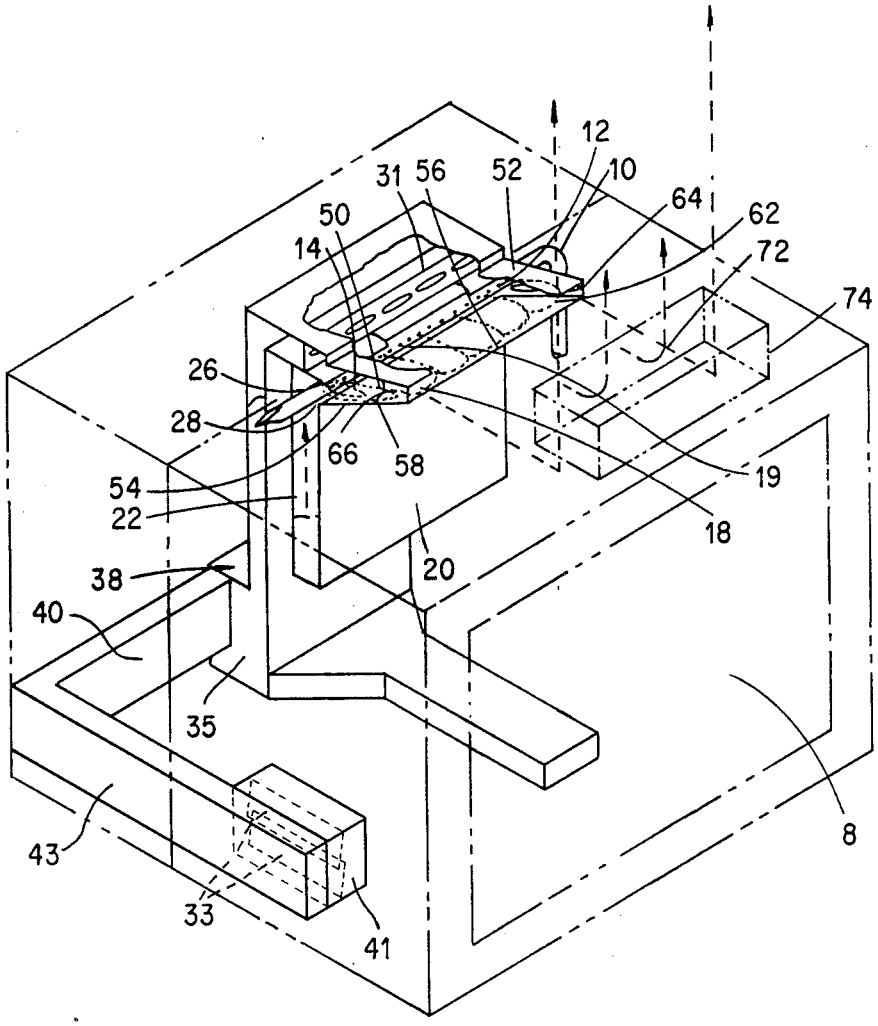
FIG. 3 is a perspective view of a gas stove utilizing the flame switchable gas burning device illustrating the air flow and the flame configuration when the stove is operated in the broil mode.
Figure 4:
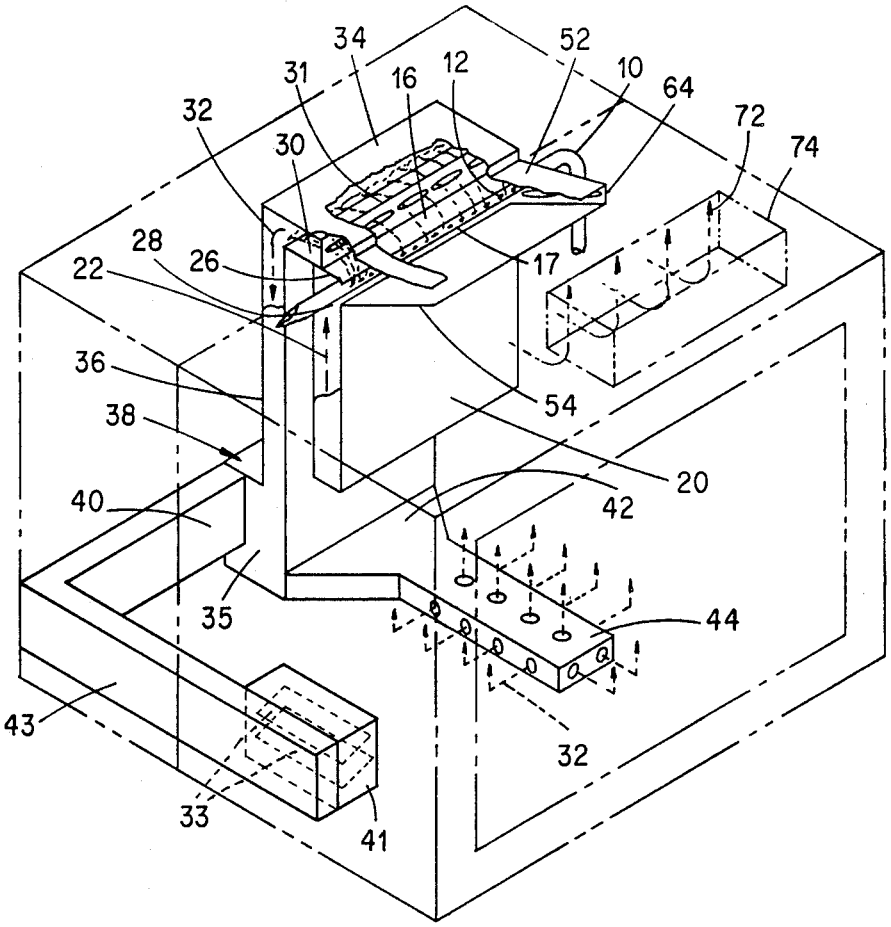
FIG. 4 is a perspective view of a gas stove utilizing the flame switchable gas burning device illustrating the air flow and the flame configuration when the stove is operated in the bake/self-clean mode.
Figure 7:
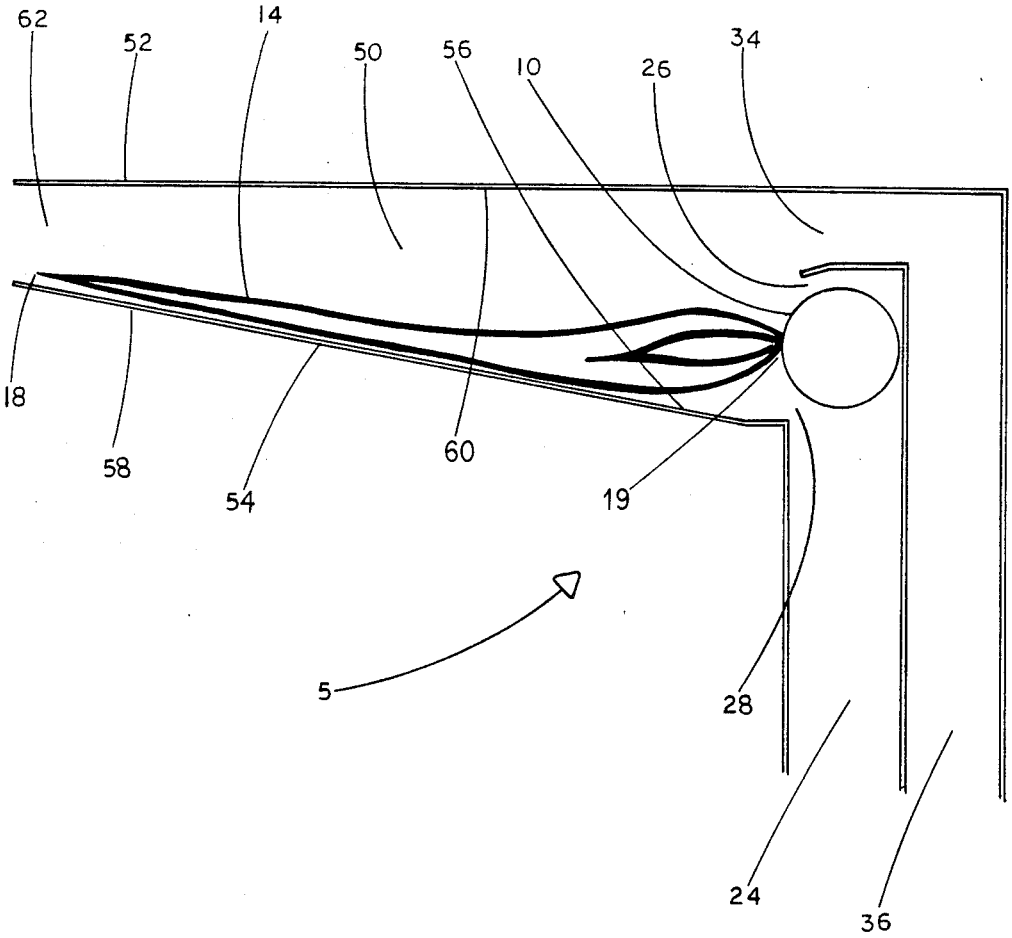
FIG. 7 is a schematic pictorial illustrating a cross section of the flame switchable gas burning device having a broil flame.
Figure 8:
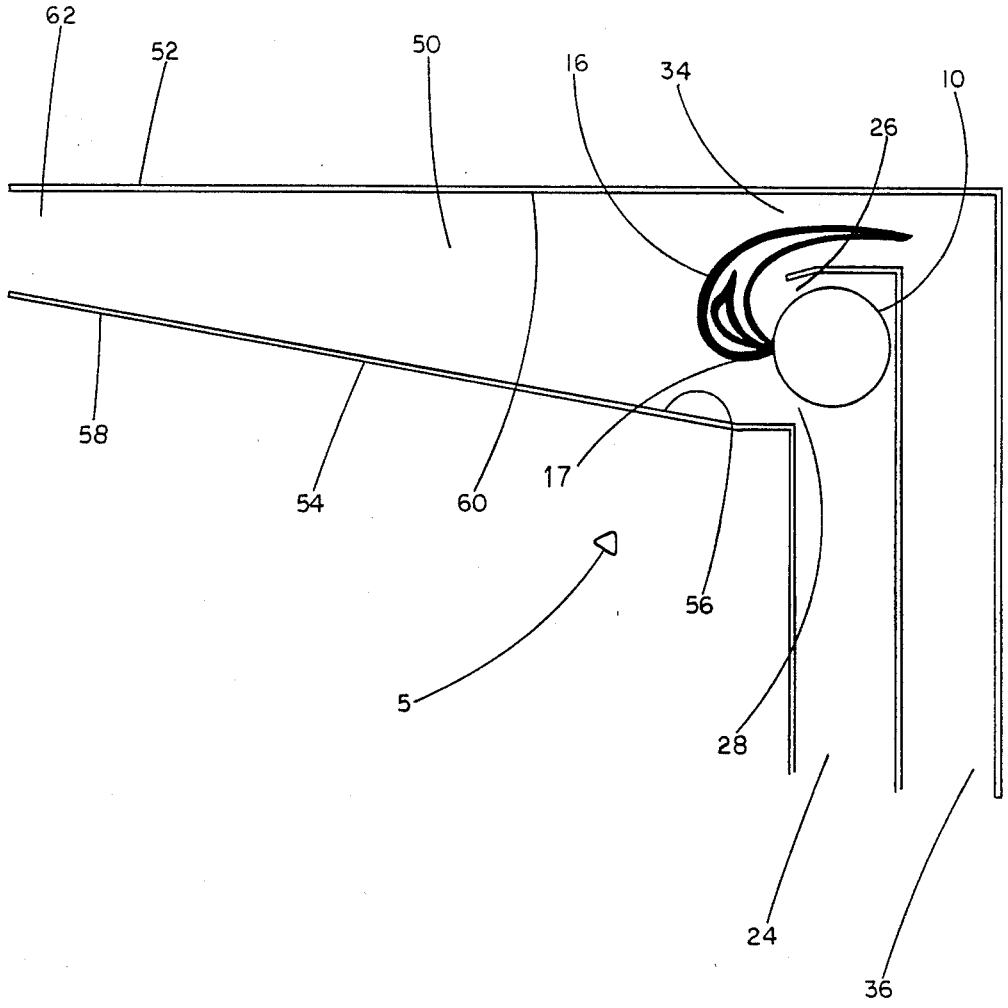
FIG. 8 is a schematic pictorial illustrating a cross section of the flame switchable gas burning device having a bake flame.

Refer now to FIGS. 1, 2, 3, 4, 7 and 8 which illustrate, in several ways, the basic operation of the invention in the broil mode and the bake/self-clean mode. FIGS. 1, 3 and 7 illustrate that when the blower 40 is in the off or broil position, such that no recirculation air 32 is flowing or such that no low pressure zone 30 is created in the proximity of the burner tube 10, the broil flame 14 from the burner tube flame ports 12 will follow the upper surface 56 of the broil flame channel shield plate 54 toward the broil flame channel opening 62. The shield plate 54 is consequently heated and such heat is radiated from the downward facing surface 58 of the shield plate 54 thereby broiling the product within the oven cavity 8 by indirect radiant heat. FIGS. 2, 4 and 8 illustrate that when the blower 40 is turned on i.e., a low pressure zone 30 is created above and to the rear of the burner tube 10 the broil flame 14 will shorten and will bend into the draw vent 34 wherein the low pressure zone 30 is established. The flame switches from a broil flame 14 to a bake flame 16 as a consequence, in part, of the low pressure zone 30 and the increase flow of fresh air 22 which is directed across the burner tube 10 by the fresh air vent 20 through an upper gap 26 and a lower gap 28 defined to be proximate to the burner tube 10. Incorporating a recirculating air duct 36 which is connected to the draw vent 34 and the input side of the blower assembly 38, which in the preferred embodiment is variable speed, and a recirculating air plenum 44 which is in air communication via a recirculating air duct 42 with the output side of the blower assembly 38 causes the flow of heated recirculation air 32 through the oven cavity 8.

The plenum 44 is typically located on a surface of the oven cavity 8 and is configured to evenly distribute the heated recirculation air 32 throughout the oven cavity 8. A controllable shunt air 45 portion of the recirculation air 32, upon introduction into the oven cavity 8, is shunted or diverted into a shunt air vent 41 through a shunt air duct 43 back into an air combining duct 35. The remainder of the recirculation air is used as flame switching air 31 for switching the flame from the broil flame 14 to the bake flame 16. The switching air volume 31 may be controlled by means of a switching air damper 31A appropriately positioned in the draw duct 36. The switching air 31 and the shunt air 45 combine in the combining duct 35 as the heated recirculation air 32 which is then blown and directed into the oven cavity 8 by the variable volume blower assembly 38. The input section 37 and the output section 39 of the blower assembly 39 are in air communication with the combining duct 35 and the recirculation air duct 42. The volume of shunt air 45 may be variably controlled with controllable shunt air dampers 33 in combination with the blower speed and damper control 33A. The elements of the invention which allow for the shunting of a portion of the recirculation air 32 permits the use of larger volume of heated recirculation air 32 without adversely affecting the character and efficiency of the bake flame 16. The amount of replacement air or fresh air 22 is also controllable due to the ability to control via control 33A the speed of the motor of the blower assembly 39 further enhancing the device 5 efficiency and advantageously affecting the cooking/baking of food products.

It is understood that the amount or volume of shunt air 45 and consequently the switching air 31 need not be variably controllable. The volumes could be preset optimally upon manufacture of the gas stove 70. The provision for variability of the air would allow for the programming of varied and optimum cooking, baking, and or broiling regimens.

In both the broil and bake/self-clean modes an amount of exhaust air 72 exhausts from the oven cavity 8. The amount which exhausts is adequate to balance the flow of fresh air 22 into the system. In the broil mode, the amount of fresh air 22 is less than when the device 5 is operating in the bake/self-clean mode. It should be pointed out that the amount of air which is exhausted and thus the amount of fresh air 22 that is brought into the system is less than in conventional prior art ovens. In part because the fresh air 22 is delivered by the fresh air vent 20 via the upper and the lower gaps 26 and 28 directly to the broil flame 14 and to the bake flame 16 and the flame ports 12 in the broil and the bake/self-clean modes, complete combustion of the flame is effected even though the recirculated air 32 is low in oxygen. It should be further noted that as a result of, in part, the directing of the fresh air 22 directly to the burner tube 10 and the flames 14 and 16 and flame ports 12, the oven cavity 8 heat up time and efficiency, in all the modes of operation, is improved.

FIGS. 3 and 4 illustrate in perspective views the flame configuration and path and the air flow through the oven cavity 8 when the device 5 is mounted in or attached to the upper rear region of the oven cavity 8 of a gas stove. FIG. 3 illustrated the operation in the broil mode and FIG. 4 illustrates the bake/self-clean mode respectively. In both FIGS. 3 and 4 the recirculation air distribution plenum 44 is depicted as being in the bottom region of the oven cavity 8. It should be understood that the recirculation air 32 may be introduced into the oven 8 via other regions of the oven 8 such as for example the rear wall as is shown in FIG. 5 or a wall opposite the location of the shunt air vent 41 and damper 33.

Figure 5:
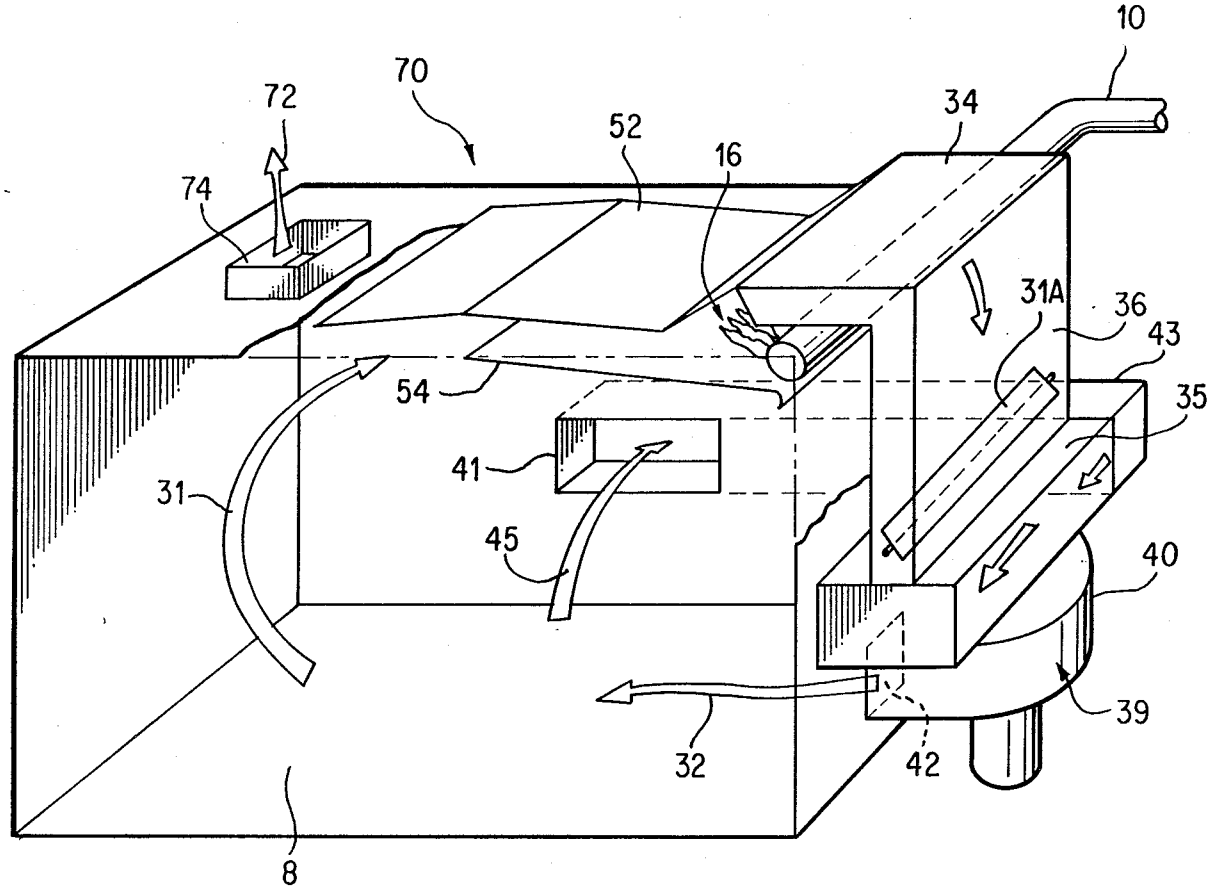
FIG. 5 is a side sectional view of an oven having the flame switchable gas burning device mounted within the oven and illustrating the draw vent, recirculation air duct, and also illustrating an example or possible geometry of the shunt air assembly.

The present invention is illustrated in FIG. 5 as an improved gas stove having a gas fired oven 70 which can perform bake, broil and self-clean operations. Considerable detail is intentionally not shown so that the basic features of the invention may be clearly discerned. This oven design 70 utilizes a single burner tube 10 located at the top of the oven cavity 8. The flame switchable gas burning device 5 is configured so as to create a low radiant flame or bake flame 16 required for baking and for self-clean and a high radiant flame 14 necessary for broiling. In the instant invention, the partially premixed atmospheric tube burner 10 which is located parallel to the back wall of the oven fires towards the center of the oven cavity 8. The flame created is either directed towards the center of the oven cavity 8 for broiling, or is turned or pulled into a draw 34 to create the low radiant flame or bake flame 16 needed for the bake/self-clean mode. The flame bending or flame switching into the draw vent 34 is accomplished by the use of a hot gas recirculation blower 40 which supplies the suction necessary for flame switching. Suction of the flame and its products of combustion into the draw vent 34 are channeled to the suction or input side of the blower assembly 38 by means of a hot gas or draw duct 36 which runs outside and parallel to the back wall of the oven cavity 8. Oven air is also drawn into the draw vent 34 as switching air 31 and subsequently into the draw duct 36 and is also mixed with the products of combustion. The output of the blower assembly 38 is directed via a recirculation air duct 42 into the oven cavity 8 as heated recirculation air 32. The shunt air 45 enters duct 41 and travels via shunt air duct 43 and then combines with heated fresh air 22 and heated switching air 31 in the combining duct 35 becoming the heated recirculation air 32. This method of recirculating oven air and hot combustion products into the oven cavity 8 creates a force convection flow through the oven cavity 8 and it introduces the heat input to the cavity 8 in such a manner that it can and flow past the bake products in a manner that produces uniform product cooking. A negative pressure or a low pressure field 30 is created and must be controlled such that the flame is not pulled off the burner tube 10, and so that the flame is bent in such a manner that it does not contact a surface before combustion is essentially complete and that the low pressure field 30 is uniform over the length of the burner tube 10 to ensure that all flames are directed into the draw vent 34. Such control is accomplished by the proper adjustment and/or control of the amounts of switching air 31, shunt air 45 and fresh air 22. The draw vent baffle plate 31, illustrated in FIG. 6, may be used for and operates to equalize the blower suction across the length of draw vent 34.

Successful flame bending is accomplished by providing sufficient space between the burner tube 10 relative to the draw vent 34 so that the flame can complete combustion before it enters the recirculation air duct 36. The bake flame 16 must enter the draw vent 34 without impinging upon any obstruction and be short enough so that it does not imping upon any part of the draw vent 34 or upon any part of the draw duct 36. There must also be provided enough unobstructed space in front of the burner flame ports 12 to allow the flame to bend without impinging on any part of the device 5.

The drawing and mixing of oven air or recirculation air 32 with the products of combustion in the recirculation air duct system 34, 36, 38, 40, 42 and 44 produces the oven recirculation and it reduces the temperature of air flowing through the duct system. Typical recirculation flows reduce recirculation air temperatures in the duct system to temperatures less than about 800° F. depending upon the setting of the oven bake temperature. These surprisingly low temperatures, even when the stove is operating in the self-clean mode make possible the use of standard oven materials such as e.g. aluminized steel. Since the stove during the bake mode has recirculated through the oven cavity 8 recirculation air 32 which contains the products of combustion and a resulting lower than normal concentration (21% by volume) of oxygen past the flame, the fresh air 22 required for secondary combustion must be delivered to the region of the burner flame ports 12. The addition of the fresh air 22 at this location ensures that the flame sees the desired level of oxygen to complete combustion, and it allows the oven cavity 8 to operate at excess air or fresh air 22 (sometimes referred to as wash through air) levels that promote efficiency of oven heating. In order to operate a prior art oven in a recirculation mode, excessive amounts of secondary or fresh air would be required in order to obtain the needed oxygen level for proper combustion of the gas at the burner ports. This large flow of air through the prior art oven results in a very inefficient oven requiring excess gas input for normal heat up times.

To deliver fresh secondary air i.e., fresh air 22 to the flame ports area, a fresh air vent 20 approximately equal in length to the burner tube length is located relative to the burner tube 10 and the flame ports 12 so that there is provided an upper and a lower gap 26 and 28 respectively which gaps 26 and 28 direct fresh air 22 to the flame ports 12. Also a fresh air duct 24 is created outside of the back wall of the oven cavity 8 which is in air communication with the fresh air vent 20 and ambient air. The action of drawing air up the duct 24 is created by the venting of exhaust air 72 from the oven cavity 8 by means of the exhaust vent 74 typically located on the top wall of the oven cavity 8 and forward of the front-facing broil flame channel opening 62. Air flow out of the oven cavity 8 creates an oven condition which in turn draws air into the oven maintaining a mass flow balance through the oven cavity 8. The recirculation blower 40 assists in the fresh air injection via the gaps 26 and 28 but the blower 40 does not have to operate when the improved oven 70 is operating in the broil mode. Adequate fresh air is vented to the flame ports 12 so that the broil flame 14 is lengthened but completes combustion as it travels toward the front of the oven cavity 8. The broil flame channel opening 62 and is attached to the shield plate 54 and within the broil flame channel 50 because of the fresh air injection and because of the relationship of the shield plate 54 to the burner tube 10 and to the spreader plate 52.

Figure 6:
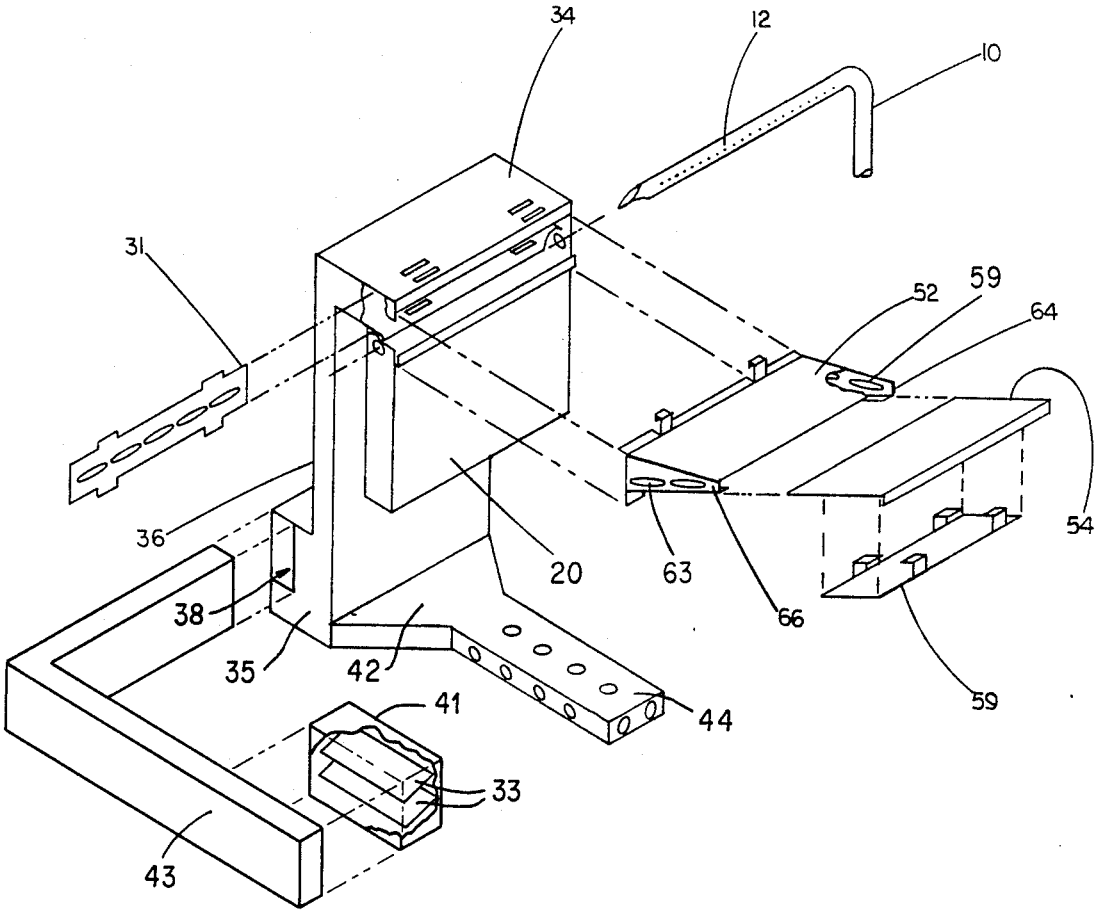
FIG. 6 is an exploded perspective view of the flame switchable gas burning device illustrating the fresh air vent, the draw vent, the burner tube, shunt air vent, duct and controllable dampers and means for creating a broil flame channel.

When the improved gas stove 70 is operated in the broil mode the blower 40 is not operating and no recirculation air 32 flows. Consequently less fresh air 22 is directed to the flame ports 12 and the flame thus directs itself toward the front of the oven cavity 8 within the broil flame channel 50 and essentially on the upward facing surface 56 of the shield plate 54. Because of the lesser amount of oxygen rich air i.e. fresh air 22 at the flame ports 12 the flame must burn longer in order to complete combustion and therefore the broil flame 14 extends forward seeking the oxygen needed. Combustion will be complete about when the leading edge of the broil flame 18 reaches the front-facing broil flame channel opening 62. The shield plate 54 is evenly heated and this heated surface looks down onto the food to provide the necessary radiant heat flux for broiling. In FIG. 6 there is shown a radiant heat equalizing plate 59 which may be used to further "even-out" the distribution of radiant heat flux. The broil flame 14 attachment to the upward facing surface 56 of the shield plate 54 requires that the shield plate 54 slope upward and forward toward the front the oven cavity 8 and that a spreader plate 52 be located above the shield plate 54 to further confine the broil flame 14 and that a sufficient sized front-facing broil flame channel opening 62 exist so as to allow the broil flame 14 to "roll up" the shield plate surface 56 and toward the exhaust vent 74. The broil flame 14 is contained substantially between the spreader plate 52 and the shield plate 54.

In another embodiment of the invention incorporates a right and a left broil flame channel enclosure panels 64 and 66 respectively. With reference to FIG. 6, it is noted that these panels can be adapted as needed by placing apertures 63 therein to more evenly distribute the broil flame 14 over the shield plate surface 56.

Figure 9:
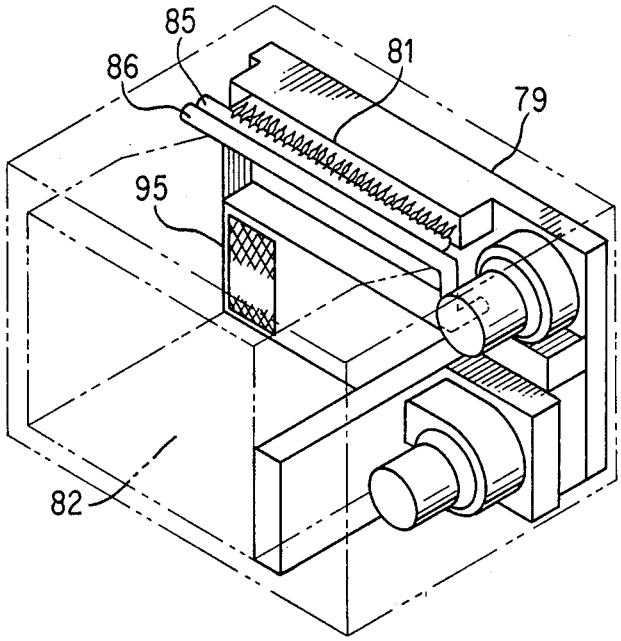
FIG. 9 is a perspective view of a gas stove utilizing the indirect fired flame switchable gas burning device illustrating possible positioning of convection air assembly and combustion air/flame switching air assembly operating in the bake/self clean mode, the broiler components being transparantly illustrated.
Figure 10:
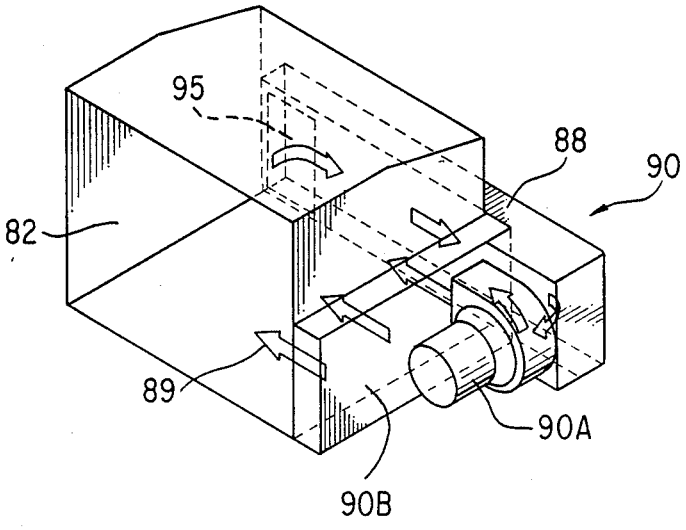
FIG. 10 is a perspective view of a gas stove utilizing the indirect fired flame switchable gas burning device illustrating the convection air flow through the oven cavity, into and out of the counterflow heat exchanger.
Figure 11:
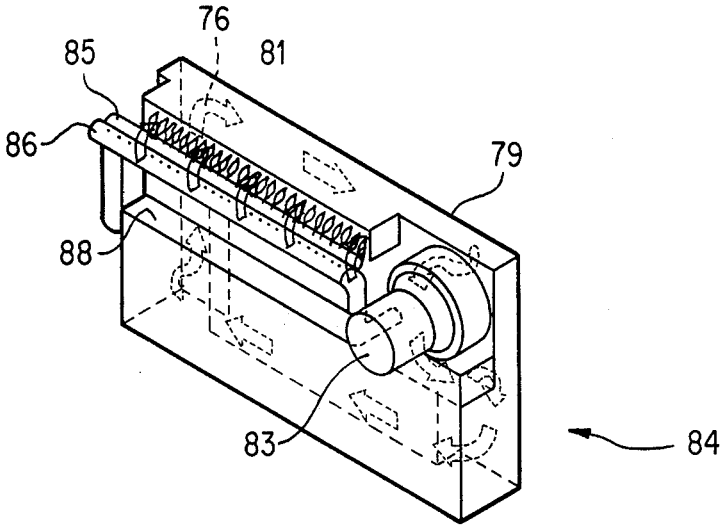
FIG. 11 is a perspective view of a gas stove utilizing the flame switchable gas burning device illustrating the combustion air/gases and flame switching air flow through the heat exchanger in counterflow to the convection air.

FIGS. 9–11 illustrate yet another embodiment of the present invention. It should be pointed out that in these FIGS. the sealed indirect fired broiler assembly 78 is shown as transparant so that the convection air assembly 90, the combustion air assembly 84 and the counterflow heat exchanger 88 may be more clearly shown in relation to each other and within the gas oven 80. The broiler assembly 78 attaches to the combustion air assembly 84 in a manner which substantially seals all of the gases of combustion whether the oven 80 is operating in the broil mode or in the bake/self clean mode. In the broil mode of operation the combustion air blower 83 and the convection air blower 90A are turned off so that the only air is that amount of fresh air 22 necessary to create the broil flame 14 within the sealed broiler assembly 78. The radiant heat flux may be introduced into the oven cavity 82 through a shield plate which may be of high temperature material such as metal or glass. The shield plate similarly configured to the shield plate 54 shown in FIG. 5 is sealably mounted at the top of the oven cavity 82 so as to maintain the integrity i.e., the separation of the combustion air 76 and the convection air 89.

In the embodiments depicted in FIGS. 9–11 the combustion gases/air 76 is kept separate from the oven air or convection air 89. That is, the combustion air 76 is integral with the combustion air assembly 84 and the broiler assembly 78. The combustion air 76 being in thermal transfer association with the convection air 89 of the convection air assembly 90 through the counterflow heat exchanger 88. The flame switchable single burner 85 is thus said to be indirect fired. In the combustion air assembly 84 the blower 83 causes combustion air 76 which is made up of an amount of fresh air 22 and flame switching air 87 to be circulated and recirculated and heated by the bake flame 16. Flame switching air 87 is distributed over the length of the flame by means of switching air flow director 86 which acts to divert, from the outlet end of the blower 83 a portion of the combustion air 76 to be used as switching air 87. The switching air 87 and fresh air 22 are directed appropriately to or across the burner tube 85 and into draw vent 81 thereafter into draw duct 81. The heated combustion air 76 passes through a combustion air passage 92 via inlet and outlet 91 and 93 respectively. Heat is transferred to the convection air 89 which is passing through the convection air passage 94 of the heat exchanger 88 preferrably in direction opposite that of the combustion air 76. The passages 92 and 94 are in thermal communication. The convection air 89 enter inlet 95 of heat exchanger 88 which is in air communication with the oven cavity 82, air 89 passes through passages 94 exits heat exchanger 88 via outlet 96 is in air communication with convection air duct 90B via blower 90A.

Figure 13:
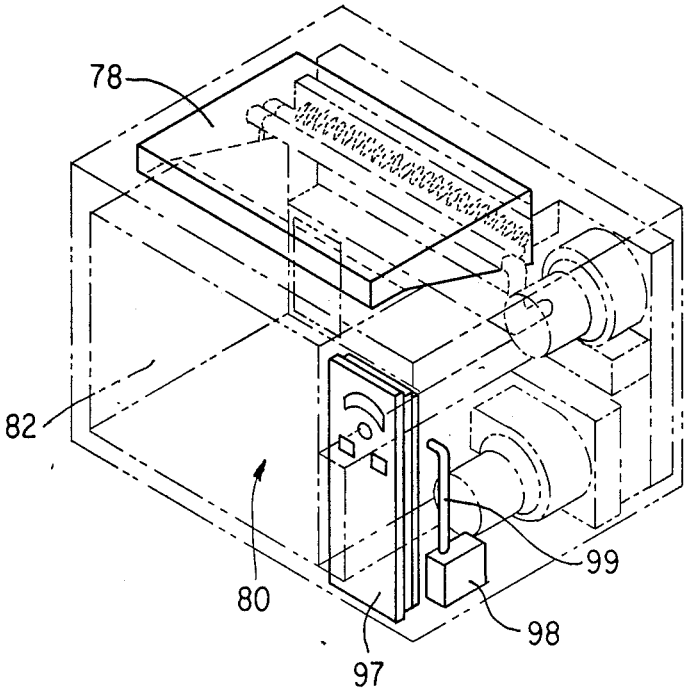
FIG. 13 is a perspective view of a gas stove utilizing the flame switchable gas burning device illustrating schematically the steam generation and injection means in a possible location in the stove assembly.
Figure 12A:
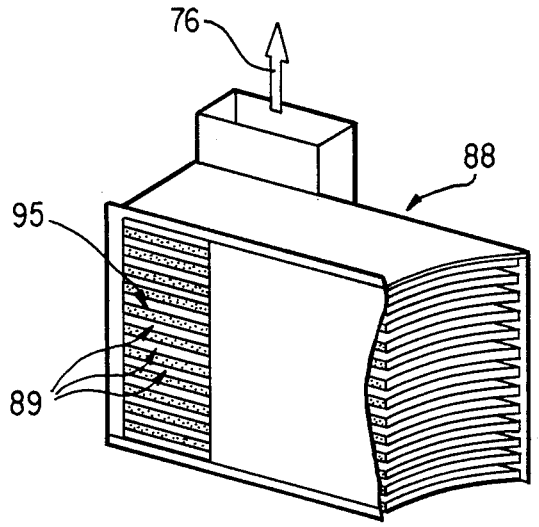
FIGS. 12A, 12B and 12C show detail of the counterflow heat exchanger.
Figure 12B:
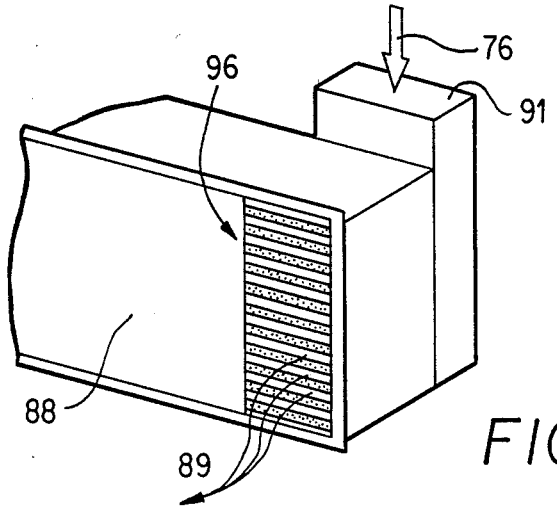
Figure 12C:
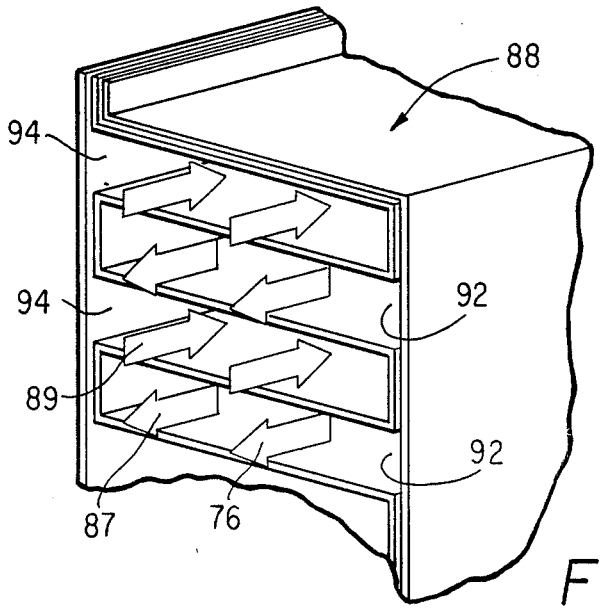

In FIG. 13 there is pictorially illustrated a steam generation means 98 and a steam injection means 99. Since the combustion air 76 and the convection air 89 are separate and since the loss of convection air 89 occurs substantially only when the oven cavity 82 is opened, it becomes feasible to use steam to enhance cooking and baking and to reduce the time needed to properly prepare foods. It is significant to note that by using steam, the cooking time would be about twice as fast as the cooking time for an oven not using steam or a conventional prior art oven. The cooking time would be almost as fast as a microwave oven but the oven of this invention using steam would not be nearly as load sensitive as are the microwave ovens. Additionally, since the present invention uses gas instead of electricity, it would be capable of higher and more flexible rates of heat input. Since the instant invention may also be microprocessor controlled, it would be possible to have numerous preprogrammed recipes which use optimally the various cooking modes available in the instant invention.

It should be further noted that combinations of modes of cooking are possible. That is, it is possible to both steam and convection cook simultaneously. It is also possible to sequence broiling, steaming and convection cooking in any order. For example, a roast beef cut of moderate tenderness might be baked first in dry heat at high temperature to develop exterior color and flavor, then cooked at more moderate temperatures with controlled steam input to tenderize and complete the cooking process in faster time than with dry heat only.

It is thought that the flame switchable gas burning device of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A flame switchable gas burning device for use as a radiant and a convection heat source in a gas stove having an oven cavity therein said device comprising:

a burner tube having a plurality of front-facing flame ports thereon;

means for substantially directing fresh air through an upper and a lower gap proximate to said burner tube over substantially the length of said burner tube;

means for creating a low pressure zone over the length of said burner tube above and rearward of said burner tube, said low pressure zone adequate in size to allow the passage therethrough of a flame which will emanate from said flame ports when said burner tube is appropriately connected to a source of gas and is appropriately ignited and said means for creating a low pressure zone also causing recirculation air to flow from said low pressure zone into said oven cavity;

means for activating and deactivating said means for creating a low pressure zone thereby causing said flame to switch from bake to broil when said means for creating a low pressure zone is deactivated;

a broil flame channel within which a broil flame from said flame ports is contained when said means for creating a low pressure zone is deactivated, comprising a spreader plate having a width substantially equal to the length of said burner tube and appropriately positioned above said burner tube and associated with said low pressure zone so as to permit a flame from said flame ports to enter said low pressure zone, when said low pressure zone is present, without substantially impinging onto said spreader, and a shield plate having a width substantially equal to the width of said spreader plate, one end positioned appropriately below said burner tube and in association with said lower gap and sloping upwardly and toward said spreader plate thereby creating said broil flame channel and having a front-facing broil flame channel opening with a height dimension less than the rearward spacing between said spreader and said shield, said broil flame distributed over and attached to said shield plate;

means for diverting a controllable portion of said recirculation air creating shunt air and an appropriate volume of flame switching air said flame switching air directed toward said burner tube and into said low pressure zone and said shunt air combines with said switching air and recirculated as said recirculation air by said means for creating a low pressure zone; and means for attaching said gas burning device to the roof surface of said oven cavity.

2. The flame switchable gas burning device according to claim 1 further comprising a means for distributing the recirculated air entering said oven cavity said means configured and positioned within said oven cavity to cause a substantially even temperature distribution throughout said oven cavity.

3. The flame switchable gas burning device according to claim 2 wherein said broil flame channel further comprises a right and a left channel enclosure panels said right panel is attached above to one edge of the spreader and below to one edge of the shield plate and said left enclosure panel is attached above to another edge of the spreader and below to another edge of the shield plate.

4. The flame switchable gas burning device according to claim 3 wherein said right and left channel enclosure panels have at least one aperture contained thereon to aid in the even distribution of the broil flame attached to said shield plate.

5. The flame switchable gas burning device according to claim 2 further comprising means for adjusting the intensity of said flame which when said low pressure zone is activated and said flame intensity adjusting means is set for a maximum level of said flame, will cause said oven to be cleaned when said oven is operated at high heat.

6. The flame switchable gas burning device according to claim 2 wherein said broil flame channel further comprises a radiant heat equalizing plate attached parallel to and spaced from the down-facing surface of said shield plate.

7. The flame switchable gas burning device according to claim 2 wherein said means for diverting comprises a shunt air vent for diverting an adjustable volume of shunt air therethrough having an adjustable damper positioned therein to control the volume of said shunt air;

a shunt air duct in air communication with said shunt air vent and a combining duct wherein said combining duct said shunt air and said switching air are combined as heated recirculation air and directed into said oven cavity; and an adjustable and controllable switching air damper appropriately positioned within said draw duct for adjusting the volume of said switching air.

8. The flame switchable gas burning device according to claim 7 wherein said means for creating a low pressure zone comprises a variable and adjustable volume blower assembly.

9. In an improved gas stove having an oven cavity; a means for providing partially mixed gas and air to an oven burner unit; means for sensing and for controlling the temperature of the oven cavity; means for igniting said oven burner unit; an oven access door; said improvement comprising:

a flame switchable gas burning device comprising:

a burner tube having a plurality of front-facing flame ports thereon;

means for substantially directing fresh air through an upper and a lower gap proximate to said burner tube over substantially the length of said burner tube;

means for creating a variable and adjustable level low pressure zone over the length of said burner tube above and rearward of said burner tube, said low pressure zone adequate in size to allow the passage therethrough of a flame which will emanate from said flame ports when said burner tube is appropriately connected to a source of gas and is appropriately ignited and said means for creating a low pressure zone also causing recirculation air to flow from said low pressure zone into said oven cavity;

means for diverting a controllable portion of said recirculation air creating shunt air and an appropriate volume of flame switching air said flame switching air directed toward said burner tube and into said low pressure zone and said shunt air combines with said switching air and recirculated by said means for creating a low pressure zone;

means for activating, deactivating and adjusting said means for creating a low pressure zone thereby causing said flame to switch from bake to broil when said means for creating a low pressure zone is deactivated and said adjusting means effective to control the volume of said shunt air and said switching air;

a broil flame channel within which a broil flame from said flame ports is contained when said means for creating a low pressure zone is deactivated, comprising a spreader plate having a width substantially equal to the length of said burner tube and appropriately positioned above said burner tube and associated with said low pressure zone so as to permit a flame from said flame ports to enter said low pressure zone, when said low pressure zone is present, without substantially impinging onto said spreader, and a shield plate having a width substantially equal to the width of said spreader plate one end positioned appropriately below said burner tube and in association with said lower gap and sloping upwardly and toward said spreader plate thereby creating said broil flame channel and having a front-facing broil flame channel opening with a height dimension less than the rearward spacing between said spreader and said shield, said broil flame distributed over and attached to said shield plate;

a means for venting exhaust air from within said oven cavity, the opening of said venting means appropriately positioned on the roof surface of said oven and proximate to the front-facing edge of said spreader plate; and means for attaching said flame switchable gas burning device to the roof surface of said oven cavity.

10. The improved gas stove according to claim 9 further comprising a means for distributing the recirculated air entering said oven cavity said means configured and positioned within said oven cavity to cause a substantially even temperature distribution throughout said oven cavity.

11. The improved gas stove according to claim 10 wherein said broil flame channel further comprises a right and a left channel enclosure panels said right panel is attached above to one edge of the spreader and below to one edge of the shield plate and said left enclosure panel is attached above to another edge of the spreader and below to another edge of the shield plate.

12. The improved gas stove according to claim 11 wherein said right and left channel enclosure panels have at least one aperture contained thereon to aid in the even distribution of the broil flame attached to said shield plate.

13. The improved gas stove according to claim 9 further comprising means for adjusting the intensity of said flame which when said low pressure zone is activated and said flame intensity adjusting means is set for a maximum level of said flame, will cause said oven to be cleaned when said oven is operated at high heat.

14. The improved gas stove according to claim 9 wherein said broil flame channel further comprises a radiant heat equalizing plate attached parallel to and spaced from the down-facing surface of said shield plate.

15. The improved gas stove according to claim 12 wherein said broil flame channel further comprises a radiant heat equalizing plate attached parallel to and spaced from the down-facing surface of said shield plate.

16. The improved gas stove according to claim 10 wherein said means for diverting comprises a shunt air vent for diverting an adjustable volume of shunt air therethrough having an adjustable damper positioned therein to control the volume of said shunt air;

a shunt air duct in air communication with said shunt air vent and a combining duct wherein said combining duct said shunt air and said switching air are combined as heated recirculation air and directed into said oven cavity; and an adjustable and controllable switching air damper appropriately positioned within said draw duct for adjusting the volume of said switching air.

17. The improved gas stove according to claim 16 wherein said means for creating a low pressure zone comprises a variable and adjustable volume blower assembly.

18. In an improved gas stove having an oven cavity; a means for providing partially mixed gas and air to an oven burner unit; means for sensing and for controlling the temperature of the oven cavity; means for igniting said oven burner unit; an oven access door; said improvement comprising:

a flame switchable gas burning device comprising:

a burner tube having an upper, a lower, a front, and a rear surface;

a plurality of flame ports situated on said burner front surface;

a fresh air vent having an opening proximate to said burner tube and having a length substantially equal in length to said tube and positioned so as to create a lower gap and an upper gap both gaps along the length of said tube, said lower gap and upper gap comprising the lower surface and the lower edge and the upper surface and the upper edge of said burner tube and said fresh air vent opening respectively;

a fresh air duct in air communication with said fresh air vent and with fresh air;

a draw vent for drawing switching air therethrough having an opening and said opening having a length substantially equal in length to said burner tube and a height adequate to allow the passage therethrough of a flame which will emanate from said flame ports when said burner tube is appropriately connected to a source of gas and is appropriately ignited and said opening positioned above said tube and said fresh air vent;

a flame draw duct in communication with said draw vent and an input side of a variable and adjustable blower assembly;

a shunt air vent for diverting an adjustable volume of shunt air therethrough having an adjustable damper positioned therein to control the volume of said shunt air;

a shunt air duct in air communication with said shunt air vent and a combining duct wherein said combining duct said shunt air and said switching air are combined as heated recirculation air and directed into said oven cavity;

an adjustable and controllable switching air damper appropriately positioned within said draw duct for adjusting the volume of said switching air;

means for turning on, turning off and adjusting said blower assembly and thereby switching said flame into said draw vent when said blower is on;

a recirculation air distribution plenum in air communication with the output of said blower assembly said plenum configured and positioned within said oven cavity to cause a substantially even temperature distribution throughout said oven cavity;

a spreader plate having a width substantially equal to the length of said flame draw vent opening said spreader plate attached at the rear edge of said spreader plate to the top surface of said draw vent, said spreader plate slopes upwardly from the rear edge to the front-facing edge which front-facing edge is attachable to the roof surface of said oven cavity;

a means for venting exhaust air from within said oven cavity, the opening of said venting means appropriately positioned on the roof surface of said oven and proximate to the front-facing edge of said spreader plate;

a shield plate having a width substantially equal to the length of said fresh air vent and the rear edge of said shield plate attached to the lower edge of said fresh air vent, said shield plate slopes upwardly from the rear edge to the front-facing edge more steeply than the slope of said spreader plate and the front-facing edge of said shield plate spaced from the down-facing surface of said spreader plate thereby creating a front-facing broil flame channel opening and the spreader and the shield plates forming a broil flame channel therebetween extending from said broil flame channel opening rearward to said flame ports; and means for mounting said flame switchable gas burning device in the upper rear portion within said oven cavity.

19. A method of providing for baking, broiling and pyrolytic self-cleaning in a gas oven having a single burner tube flame switchable gas burning device comprising the steps of:

directing fresh air through an upper and a lower gap proximate to the burner tube and the flame ports thereon;

creating a broil flame channel into which a flame, when present, will be established as a broil flame on and attached to an upward-facing surface of a shield plate and below a downward-facing surface of a spreader plate and said broil flame extending from the flame ports to at least the front-facing edge of the shield plate;

attaching the broil flame to the upward-facing surface of the shield plate by providing to the burner flame ports an appropriate amount of fresh air so that the flame will extend in order to obtain sufficient oxygen to complete combustion and will, because of the buoyancy of the broil flame and the geometry of the broil flame channel, effectively attach to the upward-facing surface of the shield plate and be forced away and downward from the downward facing surface of the spreader, the broil flame thereby heating the shield plate which downward-facing surface thereof broils products in radiant heat communication with said heated downward facing shield plate surface;

switching the broil flame to a bake flame by creating an adjustable pressure low pressure zone above and proximate to the burner tube by generating a recirculation air flow which recirculation air flow causes an increase in the amount of fresh air so that the broil flame shortens in length and is redirected from the broil flame channel into a draw vent which draw vent is contiguous with said low pressure zone said switching of the flame from a broil flame to a bake flame effective to decouple the broil and bake functions within the flame switchable gas burning device;

heating the recirculation air and the fresh air with the bake flame to a presettable temperature;

distributing said recirculation air substantially evenly throughout the oven cavity;

controllably diverting a portion of said recirculation air as shunt air away from said draw vent thereby allowing for increased volume of said recirculation air without affecting said bake flame; and cleaning the oven cavity by switching to the bake mode and setting a high presettable temperature.

20. A flame switchable gas burning device for use as a radiant and a convection heat source in a gas stove having an oven cavity therein said device comprising:

a burner tube having an upper, a lower, a front, and a rear surface;

a plurality of flame ports situated on said burner front surface;

a fresh air vent having an opening proximate to said burner tube and having a length substantially equal in length to said tube and positioned so as to create a lower gap and an upper gap both gaps along the length of said tube, said lower gap and upper gap comprising the lower surface and the lower edge and the upper surface and the upper edge of said burner tube and said fresh air vent opening respectively;

a fresh air duct in air communication with said fresh air vent and with fresh air;

a draw vent in air communication with a blower assembly and having an opening and said opening having a length substantially equal in length to said burner tube and a height adequate to allow the passage therethrough of a flame which will emanate from said flame ports when said burner tube is appropriately connected to a source of gas and is appropriately ignited and said opening positioned above said tube and said fresh air vent;

a recirculation air distribution plenum in air communication with the output of said blower assembly said plenum configured and positioned within said oven cavity to cause a substantially even temperature distribution throughout said oven cavity;

a spreader plate having a width substantially equal to the length of said flame draw vent opening said spreader plate attached at the rear edge of said spreader plate to the top surface of said draw vent, said spreader plate slopes upwardly from the rear edge to the front-facing edge which front-facing edge is attachable to the roof surface of said oven cavity;

a shield plate having a width substantially equal to the length of said fresh air vent and the rear edge of said shield plate attached to the lower edge of said fresh air vent, said shield plate slopes upwardly from the rear edge to the front-facing edge more steeply than the slope of said spreader plate and the front-facing edge of said shield plate spaced from the down-facing surface of said spreader plate thereby creating a front-facing broil flame channel opening and the spreader and the shield plates forming a broil flame channel therebetween extending from said broil flame channel opening rearward to said flame ports;

a shunt air vent for diverting an adjustable volume of shunt air therethrough having an adjustable damper positioned therein to control the volume of said shunt air;

a shunt air duct in air communication with said shunt air vent and a combining duct wherein said combining duct said shunt air and said switching air are combined as heated recirculation air and directed into said oven cavity;

an adjustable and controllable switching air damper appropriately positioned within said draw duct for adjusting the volume of said switching air; and means for mounting said flame switchable gas burning device in the upper rear portion within said oven cavity.

21. A flame switchable gas burning device for use as a radiant and a convection heat source in a gas stove having an oven cavity therein said device comprising:

means for providing convection air into said oven cavity;

means for generating heated combustion gases having a flame switchable burner assembly, flame switchable from being said radiant heat source for broiling to said convection heat source for cooking and oven cleaning, wherein said heated combustion gases are integral to said means for generating said gases and separate from said convection air;

means for activating said flame switching from being said radiant heat source for broiling to said convection heat source for cooking and oven cleaning;

means for transferring heat from said heated combustion gases to said convection air; and means for attaching said gas burning device to said gas stove maintaining integrity of said combustion gases and such that said convection air is in air communication with said oven cavity and said radiant heat source is in radiant heat communication with said oven cavity.

22. The flame switchable gas burning device according to claim 21 wherein said means for transferring heat is a counterflow heat exchanger which maintains separation of said heated combustion gases and said convection air.

23. The flame switchable gas burning device according to claim 22 wherein said means for generating heated combustion gases comprises a burner tube having a plurality of front-facing flame ports thereon; means for substantially directing fresh air and diverting a portion of said heated combustion gases as flame switching air through an upper and lower gap proximate to said burner tube over substantially the length of said burner tube; means for creating a low pressure zone over the length of said burner tube above and rearward of said burner tube, said low pressure zone adequate in size to allow the passage therethrough of a flame which will emanate from said flame ports when said burner tube is appropriately connected to a source of gas and is appropriately ignited and said means for creating a low pressure zone also causing recirculation of said heated combustion gases, said fresh air and said flame switching air from said low pressure zone into said means for transferring heat; means for activating and deactivating said means for creating a low pressure zone thereby causing said flame to switch from bake to broil when said means for creating a low pressure zone is deactivated; a broil flame channel within which a broil flame from said flame ports is contained when said means for creating a low pressure zone is deactivated, comprising a spreader plate having a width substantially equal to the length of said burner tube and appropriately positioned above said burner tube and associated with said low pressure zone so as to permit a flame from said flame ports to enter said low pressure zone, when said low pressure zone is present, without substantially impinging onto said spreader, and a shield plate having a width substantially equal to the width of said spreader plate, one end positioned appropriately below said burner tube and in association with said lower gap and sloping upwardly and toward said spreader plate thereby creating said broil flame channel and having a front-facing broil flame channel opening with a height dimension less than the rearward spacing between said spreader and said shield, said broil flame distributed over and attached to said shield plate.

24. The flame switchable gas burning device according to claim 22 wherein said means for providing convection air into said oven cavity comprise a convection air blower assembly causing said convection air to circulate through said oven cavity and in heat exchange communication with said combustion gases through a convection air passage of said heat exchanger.

25. The flame switchable gas burning device according to claim 23 wherein said means for creating said low pressure zone comprises a draw vent having an opening and said opening having a length substantially equal in length to said burner tube and a height adequate to allow the passing therethrough of a flame which will emanate from said flame ports when said burner tube is appropriately connected to a source of gas and is appropriately ignited and said opening positioned above said tube and said fresh air vent; a flame draw duct in air communication with said draw vent and an input side of said combustion gases blower assembly; an output end of said combustion gases blower assembly in air communication with an input opening of a combustion air passage of said heat exchanger, an output opening of said combustion air passage of said heat exchanger in air communication with said draw duct thereby providing a substantially closed recirculation loop for said combustion gases.

26. The flame switchable gas burning device according to claim 25 wherein said means for substantially directing fresh air and diverting a portion of said heated combustion gases as flame switching air across said burner tube comprises a fresh air and switching air director assembly which is in partial air communication with said output of said combustion gases blower assembly such that when said combustion gases blower is activated an appropriate amount of said fresh air and said flame switching air is provided for said burner tube to cause said flame to enter said draw duct.

27. The flame switchable gas burning device according to claim 22 further comprising means for controllably generating and injecting steam into said oven cavity; means for controlling said steam generation and injection; and means for appropriately mounting said steam generation means onto said gas stove.

28. A flame switchable indirect fired gas burning device for use as a radiant and a convection heat source in a gas stove having an oven cavity therein said device comprising:

a convection air assembly adapted to provide heated convection air into said oven cavity;

a combustion assembly having therein a flame switchable gas burner assembly and a radiant heat broiling assembly wherein heated combustion gases are in thermal communication with said convection air but distinct and separate from said convection air thus causing said convection air to be heated convection air;

a heat transfer assembly for the transfer of heat from said heated combustion gases to said convection air and wherein said heat transfer assembly maintains said distinctness and separation of said heated combustion gases and said convection air; and means for attaching said gas burning device to said oven cavity.

29. The flame switchable indirect fired gas burning device according to claim 28 further comprising a controllable steam generation and steam injection assembly for injecting steam into said oven cavity; means for controlling said steam generation and injection; and means for appropriately mounting said steam generation means onto said gas stove.

30. In an improved gas stove having an oven cavity; a means for providing partially mixed gas and air to an oven burner unit; means for sensing and for controlling the temperature of the oven cavity; means for igniting said oven burner unit; an oven access door; said improvement comprising:

means for providing convection air into said oven cavity;

means for generating heated combustion gases having a flame switchable burner assembly, flame switchable from being said radiant heat source for broiling to said convection heat source for cooking and oven cleaning, wherein said heated combustion gases are integral to said means for generating said gases and separate from said convection air;

means for activating said flame switching from being said radiant heat source for broiling to said convection heat source for cooking and oven cleaning;

means for transferring heat from said heated combustion gases to said convection air; and means for attaching said gas burning device to said gas stove maintaining integrity of said combustion gases and such that said convection air is in air communication with said oven cavity and said spreader plate is in radiant heat communication with said oven cavity.

31. The improved gas stove according to claim 30 wherein said means for transferring heat is a counterflow heat exchanger which maintains separation of said heated combustion gases and said convection air.

32. The improved gas stove according to claim 31 wherein said means for generating heated combustion gases comprises a burner tube having a plurality of front-facing flame ports thereon; means for substantially directing fresh air and diverting a portion of said heated combustion gases as flame switching air through an upper and a lower gap proximate to said burner tube over substantially the length of said burner tube; means for creating a low pressure zone over the length of said burner tube above and rearward of said burner tube, said low pressure zone adequate in size to allow the passage therethrough of a flame which will emanate from said flame ports when said burner tube is appropriately connected to a source of gas and is appropriately ignited and said means for creating a low pressure zone also causing recirculation of said heated combustion gases, said fresh air and said flame switching air from said low pressure zone into said means for transferring heat; means for activating and deactivating said means for creating a low pressure zone thereby causing said flame to switch from bake to broil when said means for creating a low pressure zone is deactivated; a broil flame channel within which a broil flame from said flame ports is contained when said means for creating a low pressure zone is deactivated, comprising a spreader plate having a width substantially equal to the length of said burner tube and appropriately positioned above said burner tube and associated with said low pressure zone so as to permit a flame from said flame ports to enter said low pressure zone, when said low pressure zone is present, without substantially impinging onto said spreader, and a shield plate having a width substantially equal to the width of said spreader plate, one end positioned appropriately below said burner tube and in association with said lower gap and sloping upwardly and toward said spreader plate thereby creating said broil flame channel and having a front-facing broil flame channel opening with a height dimension less than the rearward spacing between said spreader and said shield, said broil flame distributed over and attached to said shield plate.

33. The improved gas stove according to claim 31 wherein said means for providing convection air into said oven cavity comprises a convection air blower assembly causing said convection air to circulate through said oven cavity and in heat exchange communication with said combustion gases through a convection air passage of said heat exchanger.

34. The improved gas stove according to claim 31 further comprising means for controllably generating and injecting steam into said oven cavity; means for controlling said steam generation and injection; and means for appropriately mounting said steam generation means onto said gas stove.

35. The improved gas stove according to claim 32 wherein said means for creating said low pressure zone comprises a draw vent having an opening and said opening having a length substantially equal in length to said burner tube and a height adequate to allow the passing therethrough of a flame which will emanate from said flame ports when said burner tube is appropriately connected to a source of gas and is appropriately ignited and said opening positioned above said tube and said fresh air vent; a flame draw duct in air communication with said draw vent and an input side of said combustion gases blower assembly; an output end of said combustion gases blower assembly in air communication with an input opening of said combustion air passage of said heat exchanger, an output opening of said combustion air passage of said heat exchanger in air communication with said draw duct thereby providing a substantially closed recirculation loop for said combustion gases.

36. The improved gas stove according to claim 35 wherein said means for substantially directing fresh air and diverting a portion of said heated combustion gases as flame switching air across said burner tube comprises a fresh air and switching air director assembly which is in partial air communication with said output of said combustion gases blower assembly such that when said combustion gases blower is activated an appropriate amount of said fresh air and said flame switching air is provided for said burner tube to cause said flame to enter said draw duct.

37. A method of providing for baking, broiling, steam cooking and pyrolytic self-cleaning in a gas oven having a single burner tube flame switchable gas burning device comprising the steps of:

creating heated combustion gases using a flame switchable burner assembly, flame switchable from being a radiant heat source for broiling to a convection heat source for cooking and oven cleaning, wherein said heated combustion gases are integral to said means for generating said gases and separate from said convection air;

providing heated convection air into said oven cavity;

distributing said heated convection air substantially evenly throughout the oven cavity;

attaching said flame switchable burner assembly to said gas oven maintaining integrity of said combustion gases and such that said heated convection air is in air communication with said oven cavity and said radiant heat source is in radiant heat communication with said oven cavity;

activating said flame switching from being said radiant heat source for broiling to said convection heat source for cooking and oven cleaning;

transferring heat from said heated combustion gases to said convection air obtaining said heated convection air;

generating a controllable amount of steam and injecting steam into said oven cavity;

adjusting the volume of said steam generated and injected;

mounting said steam generation means onto said gas oven; and cleaning said oven cavity by switching to the bake mode and setting a high presettable temperature.

* * * * *